United States Patent [19]

Kageyama

[11] Patent Number: 4,583,874

[45] Date of Patent: Apr. 22, 1986

[54] KNOCK-TYPE PROPELLING PENCIL WITH STORAGE CARTRIDGE

[75] Inventor: Toshihiko Kageyama, Kawagoe, Japan

[73] Assignee: Kabushikikaisha Kotobuki, Kyoto, Japan

[21] Appl. No.: 455,550

[22] PCT Filed: Jul. 16, 1982

[86] PCT No.: PCT/JP82/00271

§ 371 Date: Dec. 13, 1982

§ 102(e) Date: Dec. 13, 1982

[87] PCT Pub. No.: WO83/00309

PCT Pub. Date: Feb. 3, 1983

[30] Foreign Application Priority Data

Jul. 17, 1981 [JP] Japan ..... 56-106487[U]

[51] Int. Cl.[4] ..... B43K 21/00; B43K 23/00; B43K 31/00

[52] U.S. Cl. ..... 401/85; 401/65; 401/86; 401/89

[58] Field of Search ..... 401/57, 85, 89, 90, 401/65, 67, 77, 86

[56] References Cited

U.S. PATENT DOCUMENTS

| | | | |
|---|---|---|---|
| 1,442,817 | 1/1923 | Moore | 401/77 |
| 1,576,146 | 3/1926 | Sheldon | 401/85 X |
| 2,287,894 | 6/1942 | Lynn | 401/86 X |
| 4,240,759 | 12/1980 | Matsumoto | 401/85 |
| 4,247,215 | 1/1981 | Leuthold et al. | 401/85 |
| 4,386,865 | 6/1983 | Kageyama et al. | 401/67 |

FOREIGN PATENT DOCUMENTS

| | | | |
|---|---|---|---|
| 50-24852 | 7/1975 | Japan . | |
| 54-51052 | 4/1979 | Japan . | |
| 684173 | 12/1952 | United Kingdom | 401/85 |

*Primary Examiner*—Steven A. Bratlie

*Attorney, Agent, or Firm*—Bernard, Rothwell & Brown

[57] ABSTRACT

A knock-type propelling pencil, of which a lead casing is made in the form of a cartridge so that supply of new spare leads can be completed by only inserting the cartridge accommodating the given leads into lead cylinder in outer cylinder and thereby making the operation of supply of the new spare leads easier.

1 Claim, 5 Drawing Figures

KNOCK-TYPE PROPELLING PENCIL WITH STORAGE CARTRIDGE

FIELD OF THE ART

This invention relates to a knock-type propelling pencil, and more specifically to a knock-type propelling pencil which makes it possible to supply the pencil with the new leads, when a writing lead accommodated in the propelling pencil in the form of a lead cartridge, is worn out.

BACKGROUND OF THE ART

In the conventional knock-type propelling pencils, spare leads are contained in a cylinder, and a new lead is readily propelled when the lead in use is worn out.

When the leads contained in the cylinder are all worn out, however, it is required to remove a knock rod from the rear end of the cylinder, take out a suitable number of leads from a separate lead container, and refill them into the cylinder, involving cumbersome operation. In particular, leads as thin as 0.5 to 0.3 mm must be treated very carefully, so that they are not broken away when they are being refilled, and so that they will not fall and will not be lost.

DISCLOSURE OF THE INVENTION

This invention was contrived in view of the above-mentioned problem inherent in the conventional devices, and its object is to provide a knock-type propelling pencil in which the lead container is constructed in the form of a cartridge which can be simply charged into the lead cylinder in the outer cylinder, so that the leads are refilled very easily.

According to one embodiment in the present invention, it is possible to realize a knock-type propelling pencil which has a lead cylinder in an outer cylinder, and which propels the lead contained in the lead cylinder by a lead-propelling mechanism upon the knocking operation, in which the knock-type propelling pencil is characterized in that a cartridge accommodation chamber 5 is formed in the rear portion of the lead cylinder, a lead cartridge consisting of a cylinder of which one end or both ends are sealed by caps is accommodated in the cartridge accommodation chamber, the lead cartridge having a diameter smaller than the inner diameter of the cartridge accommodation chamber and being capable of accommodating a required number of leads, and the cap at one end of the lead cartridge being removed, the lead cartridge is accommodated into the cartridge accommodation chamber so that the lead can be refilled.

PREFERRED EMBODIMENT FOR USE OF THE INVENTION

The invention will be described below with reference to an embodiment in conjunction with the drawings.

Figure 1:
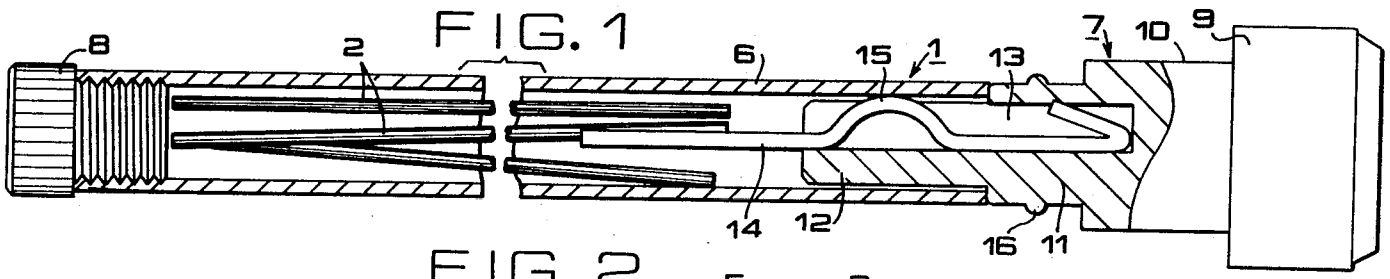
FIG. 1 is a sectional side view showing, partly omitted, a lead cartridge of a knock-type propelling pencil according to an embodiment of this invention.
Figure 2:
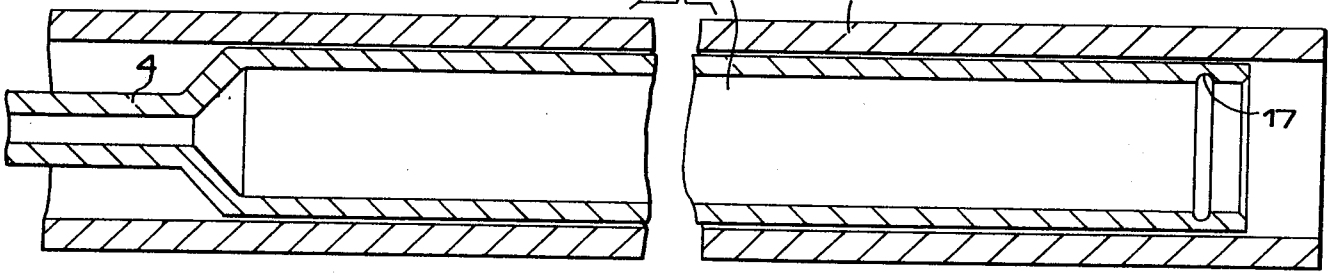
FIG. 2 is a sectional side view showing, partly omitted, the rear portion of the propelling pencil provided with the lead cartridge in FIG. 1.
Figure 3:
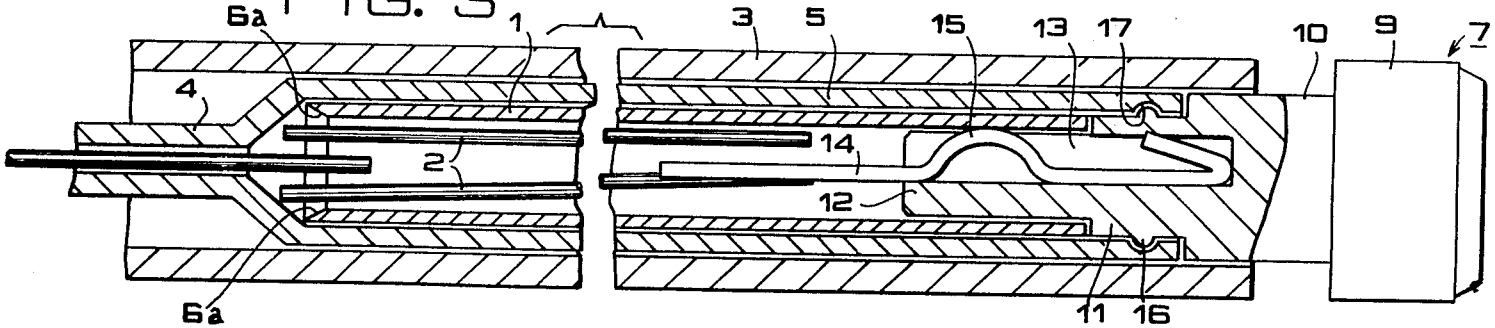
FIG. 3 is a partial sectional side view showing the state in which the lead cartridge of FIG. 1 is charged into the propelling pencil of FIG. 2.

In FIGS. 1–3 a lead cartridge 1 in the present invention is long enough to accommodate leads 2, and consists of a cylinder 6 of a diameter smaller then the inner diameter of a cartridge accommodation chamber 5 which is formed stretching from the rear end of a lead cylinder 4 in an outer cylinder 3, and caps 7, 8 for sealing both ends of the cylinder 6. The front end of cylinder 6 of the lead cartridge 1 is tapered or chamfered as shown at **6*a* in FIG. 3**.

In this embodiment shown in the drawings, the cap 7 on one side is so formed as will serve as a knock rod. That is, the cap 7 comprises a knock portion 9 of a diameter nearly equal to that of the outer cylinder 3, a slide shaft portion 10 which slides along the inner peripheral surface at the rear end of the outer cylinder 3, a coupling shaft portion 11 of a diameter nearly equal to that of the cylinder 6, and a fitting portion 12 which fits to the end of the cylinder 6 to seal it.

In the diagrammed embodiment, means for coupling the cap 7 to the cylinder 6 is constructed as mentioned below. Namely, a base portion of a lead-expelling rod 14 is fitted into a mounting hole 13 which is formed in the side of the fitting portion 12 and which is partly open, a portion of the lead-expelling rod 14 is so bent as to protrude beyond the side surface of the fitting portion 12, and a top portion of the bent portion 15 is brought into contact with the inner surface of the cylinder 6, so that the cap 7 will not be removed from the cylinder 6 undesirably. Further, the coupling between the coupling shaft 11 and the lead cylinder 4 is accomplished by a protuberance 16 formed along the outer peripheral surface of the coupling shaft 11 which is tightly fitted into a recess 17 formed along the inner peripheral surface of the lead cylinder 4. The coupling means, however, need not be limited to the above-mentioned example, but may be constructed in a variety of other ways.

Figure 4:
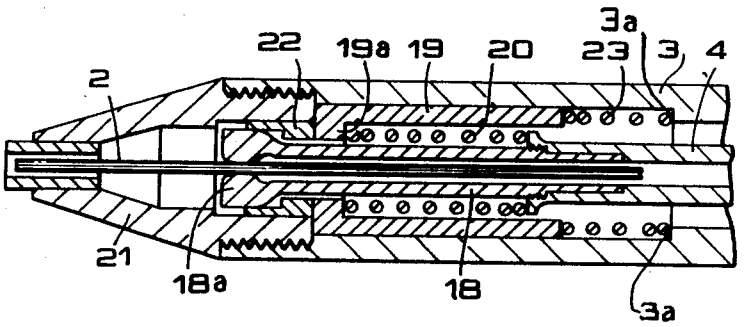
FIG. 4 is a sectional side view showing a lead-propelling mechanism in the front portion of the propelling pencil in FIG. 3.

FIG. 4 shows a mechanism for propelling the lead 2, according to which a lead chuck 18 is coupled to the tip end of the lead cylinder 4 that is inserted in the outer cylinder 3, a moving cylinder 19 is inserted in the tip end portion of the outer cylinder 3, and a first spring 20 is interposed between a jaw **19*a* of the moving cylinder 19 and the end of the lead cylinder 4**.

The tip of the lead chuck 18 protrudes from the moving cylinder 19 into an end cap 21 which is screwed to the end of the outer cylinder 3, and a chuck-fastening ring 22 is fitted around the chuck portion **18*a* of the protruded portion. When the lead chuck 18 retracts, the chuck-fastening ring 22 fastens the chuck portion 18*a* so that the lead 2** is firmly held.

A second spring 23 having a relatively small resilient force is interposed between the rear end of the moving cylinder 19 and a stepped portion **3*a* of the outer cylinder 3. Therefore, when an excessively large writing force is given to the lead 2, the moving cylinder 19 retracts overcoming the force of the second spring 23 to absorb the pressure transmitted via the lead chuck 18 and the chuck-fastening ring 22, so that the lead is prevented from being broken. The lead-propelling mechanism is made up of the chuck-fastening ring 22, lead chuck 18, moving cylinder 19 equipped with the lead cylinder 4 via the first spring 20, and the second spring 23 interposed between the moving cylinder 19 and the outer cylinder 3**, and therefore this mechanism can be assembled as a single assembly.

According to the aforementioned construction based on the present invention, to refill the lead, the cap 8 is removed from the end of the cylinder 6 shown in FIG. 1. The cylinder 6 is then inserted into the cartridge accommodation chamber 5 formed in the lead cylinder 4 in the outer cylinder 3 through the rear end of the outer cylinder 3. The coupling shaft portion 11 of cap 7 at the rear end is then fitted into the lead cylinder 4 until the protuberance 16 engages with the recessed portion 17.

After the lead cartridge 1 has been charged as mentioned above, if knock portion 9 of the cap 7 is knocked in the same manner as an ordinary propelling pencil, the knocking force is transmitted to the lead cylinder 4, whereby the lead chuck 8 is advanced to propel the lead 2.

When the leads 2 in the lead cartridge 1 have all been used, the cap 7 should be pulled out. The coupling shaft portion 11 of the cap 7 is removed from the lead cylinder 4 together with the empty cylinder 6. Then, a new lead cartridge 1 is charged in the same manner as described above. Even if any leads 2 remain in the cartridge accommodation chamber such leads can be guided and smoothly collected into the new lead cartridge 1 by means of the tapered or chamfered portion 6*a* of the lead cartridge 1. The outer diameter of the lead cartridge is smaller than the inner diameter of the cartridge accommodation chamber of the lead cylinder 4 within which the cartridge is received.

Figure 5:
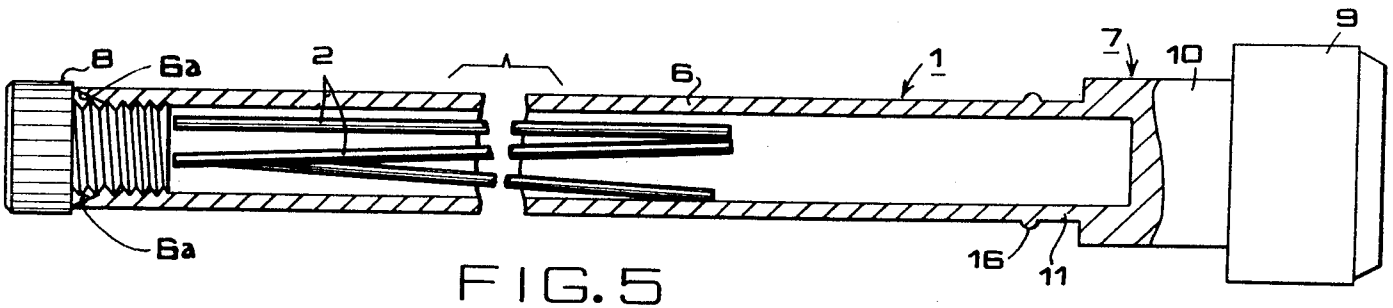
FIG. 5 is a sectional side view showing another embodiment according to this invention.

A lead cartridge according to another embodiment of this invention is shown in a sectional side view of FIG. 5, in which the same reference numerals as those of FIG. 1 denote the same members.

According to this invention as mentioned above, the leads can be refilled by simply inserting the lead cartridge which contains a predetermined number of leads into the cartridge accommodation chamber in the lead cylinder in the outer cylinder, eliminating the clumsy operation for inserting thin leads one stick by one stick. Therefore, the leads can be refilled quickly without being broken and without being fallen and lost.

Further, by using the cap at one end of the lead cartridge as a knocking member as done in the embodiments of the invention, the knocking portion can be set to a predetermined position as the cartridge is inserted in position. Moreover, there is no need of removing the knocking member from the outer cylinder for each refill, contributing to simplify the operation as well as to prevent the knocking member from being lost.

I claim:

1. A knock-type propelling pencil comprising:

(a) an outer cylinder;

(b) a lead cylinder slidably inserted in said outer cylinder and having a cartridge accommodation chamber in the rear portion of said lead cylinder;

(c) a lead-propelling mechanism provided at the front end of said lead cylinder;

(d) a lead cartridge comprising a cylinder, at least the rear end of which is closed by a cap, accommodated in said cartridge accommodation chamber, said lead cartridge having an outer diameter smaller than the inner diameter of said cartridge accommodation chamber and having a tapered portion at the front edge of said lead cartridge for collecting leads remaining in said cartridge accommodation chamber;

(e) said cap including a portion having a protuberance formed on the outer peripheral surface thereof; and (f) said lead cylinder including a recess formed along the inner peripheral surface thereof, said protuberance being tightly fitted into said recess;

(g) said cap closing the rear end of said lead cartridge being composed of a knock member and when said cartridge is inserted into said cartridge accommodation chamber, said cap is coupled to said lead cylinder to serve as a knock portion which protrudes rearwardly beyond the outer cylinder; and (h) said cap having a mounting hole formed therein, a lead-expelling rod fitted into said mounting hole, a portion of said lead-expelling rod being bent as to protrude beyond the said mounting hole, said bent portion being brought into contact with the inner surface of said lead cartridge.

* * * * *